US005794775A

United States Patent [19]

Hall

[11] Patent Number: 5,794,775

[45] Date of Patent: Aug. 18, 1998

[54] PACKAGING CONTAINER FOR ELASTIC FILAR MATERIAL

[76] Inventor: Elmer Hall, Rte. 7, Box 165, Bassett, Va. 24055

[21] Appl. No.: 718,941

[22] Filed: Sep. 24, 1996

[51] Int. Cl.[6] ..... B65D 85/04

[52] U.S. Cl. ..... 206/388; 206/407; 220/670

[58] Field of Search ..... 206/389, 398, 206/407, 408, 417, 388; 220/672, 675, 670

[56] References Cited

U.S. PATENT DOCUMENTS 3,127,012 3/1964 Smoot ..... 206/389

3,586,162 6/1971 Townsend ..... 206/389 X 5,071,029 12/1991 Umlah et al. ..... 220/672

5,397,021 3/1995 Usui ..... 220/672 X

*Primary Examiner*—Jacob K. Ackun

*Attorney, Agent, or Firm*—Larson & Taylor

[57] ABSTRACT

An improved packaging container for elastic filar material is disclosed in which the wound elastic material has uniform density and no tension. The packaging container is the form of a cylindrical wall with an open top end and an open bottom end. The cylindrical wall is corrugated such that the walls have alternating grooves and ridges. Elastic filar material is circularly wound into the packaging container in multiple layers corresponding to the grooves and ridges of the corrugations. The corrugations in the cylindrical wall act to hold the windings of material in place such that interwinding, in form of tangles or overlaps, is prevented.

9 Claims, 2 Drawing Sheets

PACKAGING CONTAINER FOR ELASTIC FILAR MATERIAL

FIELD OF THE INVENTION

The present invention relates to a packaging container for continuous lengths of filar material. More specifically the present invention is directed to packaging for continuous lengths or strips of a material having elastic properties. The packaging container allows even winding of rubber strips without creating tension in the strips and holds longer runs of material than prior art packaging containers.

BACKGROUND OF THE INVENTION

It has been common practice by elastic fabric manufacturers to split multiple-end rubber strips into single ends for use with looms and knitting machines. In addition to using multiple-end rubber strips, elastic fabric manufactures also use single-end spool packages of wound elastic material produced by winders. These packages of wound single-end elastic material possess numerous disadvantages. In particular, the packages tend to create tension on the elastic material, as well as cause side loops and tangles. The packages also tend to vary in size and cannot hold large amounts of elastic material. Furthermore, spooling these packages requires powdered rubber which can damage the knitting machines, while unwinding the packages necessitates the use of additional equipment, namely a package roll-off creel.

In the prior art packaging for filar/elongated materials, such as wire, rope, etc., the material is typically wound around a spool-like member. Such packaging is acceptable for non-elastic materials, but in the case of elastic material, as previously described, inherent problems such as tangles, overlaps, and side loops are common due to tension in the material. Thus, in the preferred packaging, coils of elongated material, are surrounded by a tubular wall.

For example, U.S. Pat. No. 2,552,594 to Scott, Jr. discloses a package wherein a coil of wire with a hollow center is surrounded by a tubular wall having a tubular liner which is adhesively bonded to the outermost layer of the coil. Half-corrugated cardboard may be used for the tubular liner with the corrugations running parallel to the axis of the coil. However, this type of packaging also results in tangles and interwinding because the layers of windings are not effectively held in place.

SUMMARY OF THE INVENTION

In accordance with the present invention, an improved packaging container for elastic filar material is provided in which the elastic material may be uniformly wound without tension. The packaging container is cylindrical and has an open top end and an open bottom end. The inner cylindrical wall of the packaging container is corrugated such that it has alternating grooves and ridges extending perpendicular to the central longitudinal axis of the packaging container. Elastic filar material is continuously wound in a circular manner into the packaging container in alternating layers corresponding to the grooves and ridges of the corrugations in the cylindrical wall.

The corrugations in the cylindrical wall provide a means for holding the windings of material in place such that interwinding, in the form of tangles or overlaps, is prevented. The wound elastic material is removed from the packaging container using either the first-in, first-out principle by inverting the container bottom end upwards and pulling the loose end of material, or the last-in, first-out principle bit pulling the loose end from the top end of the container.

In the preferred embodiment, the packaging container is used to hold single-ends of elongated rubber which are split from multiple-end rubber strips.

It is, therefore, an object of the present invention to provide a packaging container for elastic filar material in which the material may be uniformly wound without creating tension in the material.

It is another object of the present invention to provide a packaging container for elastic filar material which is capable of holding longer lengths of material than conventional packaging containers.

Other features and objects of the present invention are stated in or apparent from a detailed description of presently preferred embodiments of the invention found hereinbelow.

BRIEF DESCRIPTION OF THE DRAWINGS

There follows a detailed description of the preferred embodiments of the present invention which are to be take together with the accompanying drawings, wherein.

DETAILED DESCRIPTION OF THE PREFERRED EMBODIMENT

Figure 1:
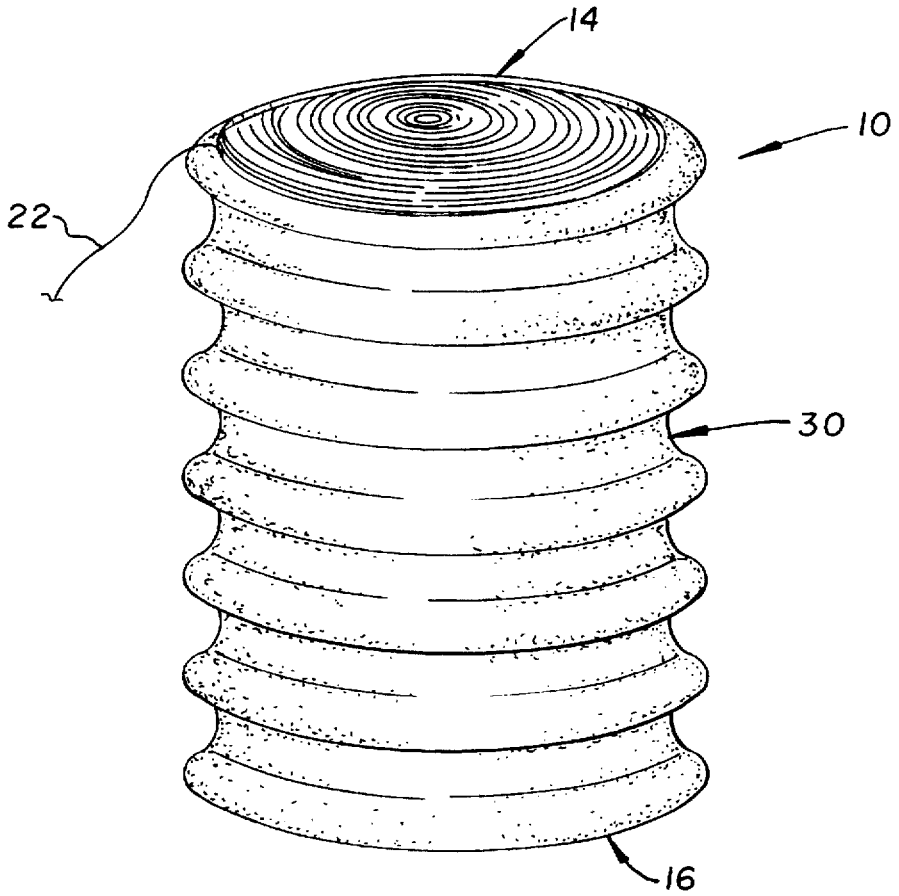
FIG. 1 is a front perspective view of the packaging container of the present invention.
Figure 2:
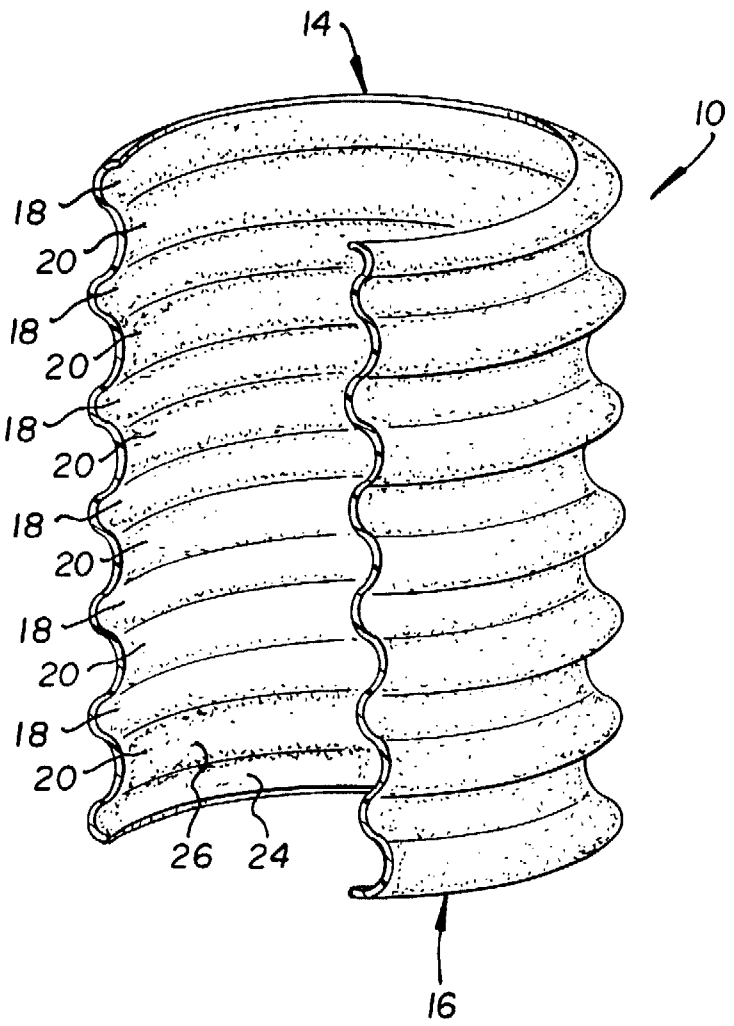
FIG. 2 is a front perspective view of the packaging container of the present invention showing the inside thereof before it has been filled with filar material.

With reference to the drawings in which like numerals represent like elements, a packaging container 10 according to the present invention is depicted in FIG. 1. Packaging container 10 includes outer cylindrical wall 30 and inner cylindrical wall 12 (shown most clearly in FIG. 2), and an open top end 14 and an open bottom end 16. Packaging container 10 is preferably constructed from a lightweight rigid plastic, although other materials may be utilized.

Inner cylindrical wall 12 includes corrugations in the form of alternating grooves 18 and ridges 20, which run perpendicular to the central longitudinal axis of inner cylindrical wall 12. Preferably, these corrugations cover the entire perimeter of the inner cylindrical wall 12, although they may only extend around a portion thereof, with a remainder of the inner cylindrical wall 12 being smooth. Top end 14 and bottom end 16 are each adjacent to grooves 18. As shown, outer cylindrical wall 30 also includes corrugations, although it may be a smooth wall.

Packaging container 10 has been successfully constructed and tested in the following sizes: (1) fourteen inches in height with alternating grooves of ten inches in diameter and ridges of nine inches in diameter every ¾ inch (from trough to peak) and (2) ten inches in height with alternating grooves of seven inches in diameter and ridges of six inches in diameter every ¾ inch. In testing, the typical weights of these packaging containers 10 when filled ranged from three to five pounds. Other heights, diameters, and trough to peak distances may, of course, be utilized. Further, although it is preferred that each of the ridges 20 has substantially the same diameter and each of the grooves 18 has substantially the same diameter, it is possible to utilize any number of different diameter grooves and ridges along the length of the container 10.

Figure 4:
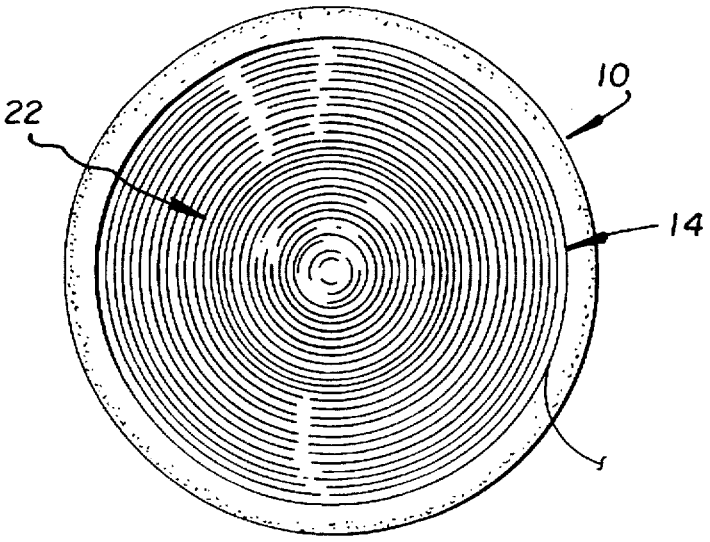
FIG. 4 is a top end view of the packaging container as depicted in FIG. 1, the bottom end being identical.
Figure 3:
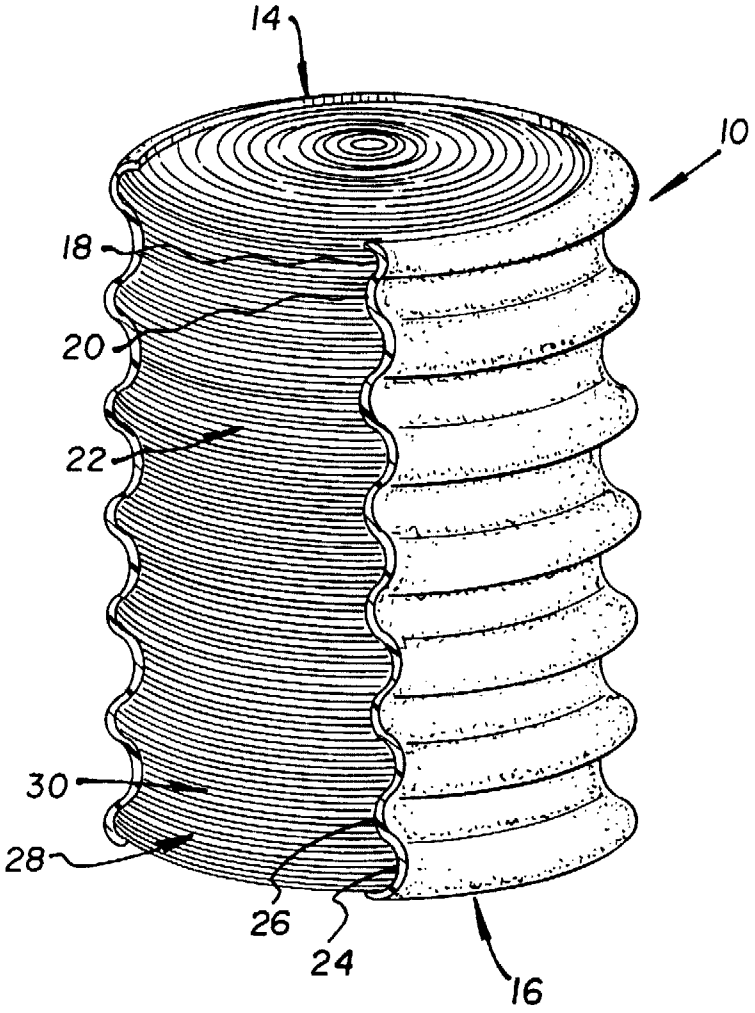
FIG. 3 is a front perspective view of the packaging container of FIG. 1 , partly broken away to show the inside layers of wound material.

As can be seen most clearly in FIGS. 1, 3, and 4, packaging container 10 is filled by circularly winding elastic filar material 22 within the inner cylindrical wall 12 in alternating layers corresponding to the grooves 18 and ridges 20. Winding is accomplished by placing a lid (not shown), which may be of any conventional type, such as a snap-on lid, on bottom end 16 to form a base. Packaging container 10 is then placed in an upright position on a platform or table-like surface such that top end 14 is facing upwards. The platform surface is then moved in a circular pattern while elastic filar material 22 is continuously lowered into packaging container 10 through top end 14.

During the filling procedure, a first layer 28 of material is first wound into packaging container 10 such that it fills bottom-most groove 24. A second layer 30 of material is then wound into packaging container 10 such that it fills bottom-most ridge 26. The winding of the material 22 in alternating layers corresponding to grooves 18 and ridges 20 continues in this manner until packaging container 10 is completely filled or a desired weight is reached. A lid (not shown) is then placed on top end 14 for storage and shipment.

As a result of this method of winding, the diameters of the layers of wound material 22 that correspond to grooves 18 are larger than the diameters of the layers of wound material 22 that correspond to ridges 20. The grooves 18 and ridges 20 hold the filar material 22 in place thereby preventing the windings of material from spilling out or becoming easily disarranged.

The wound elastic material 22 is removed from either top end 14 using the last-in, first-out principle or bottom end 16 of packaging container 10 using the first-in, first-out principle by inverting the bottom end 16 upwards. Elastic material 22 is removed in a single continuous length by simply pulling the single end material. The use of a roll-off creel is not required as in the case of spooled material since packaging container 10 does not require rotation for unwinding elastic material 22.

Although the present invention has been described with respect to an exemplary embodiment thereof, it will be understood by those of ordinary skull in the art that variations and modifications can be effected within the scope and spirit of the invention.

I claim:

1. A packaging container for filar material comprising:

a cylinder having open top and bottom ends and an inner wall comprising a plurality of alternating grooves and ridges, adjacent grooves being completely separated by a ridge, for receiving alternating layers of elongated filar material, said cylinder including at least one removable lid for closing said top end or said bottom end.

2. The packaging container according to claim 1, wherein said alternating grooves and ridges encircle said inner wall perpendicular to a central longitudinal axis of said packaging container.

3. The packaging container according to claim 2, wherein said grooves have substantially equal diameters and said ridges have substantially equal diameters, said grooves having a larger diameter than said ridges.

4. The packaging container according to claim 1 wherein said cylinder comprises a plastic material.

5. The packaging container according to claim 1 further comprising a removable lid for closing the other of said top and bottom ends.

6. A packaging container for filar material comprising;

a cylinder having an inner wall including corrugations comprising alternating grooves and ridges, adjacent grooves being completely separated by a ridge; and a plurality of layers of circular windings of elongated filar material, said windings being encased within said corrugations.

7. The packaging container according to claim 6, wherein said alternating grooves and ridges encircle said inner wall perpendicular to a longitudinal axis of said packaging container.

8. The packaging container according to claim 7, wherein each of said layers is positioned between one of said grooves or one of said ridges.

9. The packaging container according to claim 6, wherein said elongated filar material comprises an elastic material.

* * * * *